US010598336B2

(12) United States Patent
Hanulak et al.

(10) Patent No.: US 10,598,336 B2
(45) Date of Patent: Mar. 24, 2020

(54) LIGHT DEVICE FOR MOTOR VEHICLES

(71) Applicant: Varroc Lighting Systems, s.r.o., Senov u Noveho Jicina (CZ)

(72) Inventors: Patrik Hanulak, Cadca (SK); Kamil Oczko, Cesky Tesin (CZ); Peter Hajduk, Krasno nad Kysucou (SK)

(73) Assignee: Varroc Lighting Systems, S.R.O., Senov U Noveho (CZ)

( * ) Notice: Subject to any disclaimer, the term of this patent is extended or adjusted under 35 U.S.C. 154(b) by 0 days.

(21) Appl. No.: 15/670,878

(22) Filed: Aug. 7, 2017

(65) Prior Publication Data

US 2018/0038569 A1 Feb. 8, 2018

(30) Foreign Application Priority Data

Aug. 8, 2016 (CZ) ..... 2016/481

(51) Int. Cl.
*F21V 9/00* (2018.01)
*F21S 43/20* (2018.01)
(Continued)

(52) U.S. Cl.
CPC ..... *F21S 43/26* (2018.01); *F21S 43/14* (2018.01); *F21S 43/15* (2018.01); *F21S 43/241* (2018.01);
(Continued)

(58) Field of Classification Search
CPC .. F21S 43/26; F21S 43/40; F21S 43/31; F21S 43/255; F21S 41/50; F21S 43/14; F21S 43/237; F21S 43/239; F21S 43/243; F21S 43/249; F21S 43/247; F21S 43/251; F21S 43/315; F21S 43/241; F21S 41/28;
(Continued)

(56) References Cited

U.S. PATENT DOCUMENTS 6,352,359 B1 * 3/2002 Shie ..... F21V 5/002 362/522
2009/0154186 A1 * 6/2009 Natsume ..... B60Q 1/0041 362/516
(Continued)

FOREIGN PATENT DOCUMENTS

CZ 20150002 A3 2/2016
EP 1 126 209 A2 8/2001
(Continued)

*Primary Examiner* — Thien T Mai
(74) *Attorney, Agent, or Firm* — Hovey Williams LLP

(57) ABSTRACT

A light device for motor vehicles, especially a signal lamp, comprises a carrier housing (1), covered by a translucent cover (2), and an inner chamber (3) wherein at least one light source for generating light rays is mounted, and a transparent optical part (5) with at least one output surface for the output of at least a part of light rays from the transparent optical part. The light device further comprises at least one macrotexture (8) the surface of which consists of individual surfaces designed for transmission and/or reflection of a part of light rays, the macrotexture and the transparent optical part arranged in such a way that in a view of the inner chamber (3) towards the output surface through the translucent cover from the outside of the light device, the impression of a spatial effect is produced, which is even visible with the light source being off.

20 Claims, 20 Drawing Sheets

Figure 1:
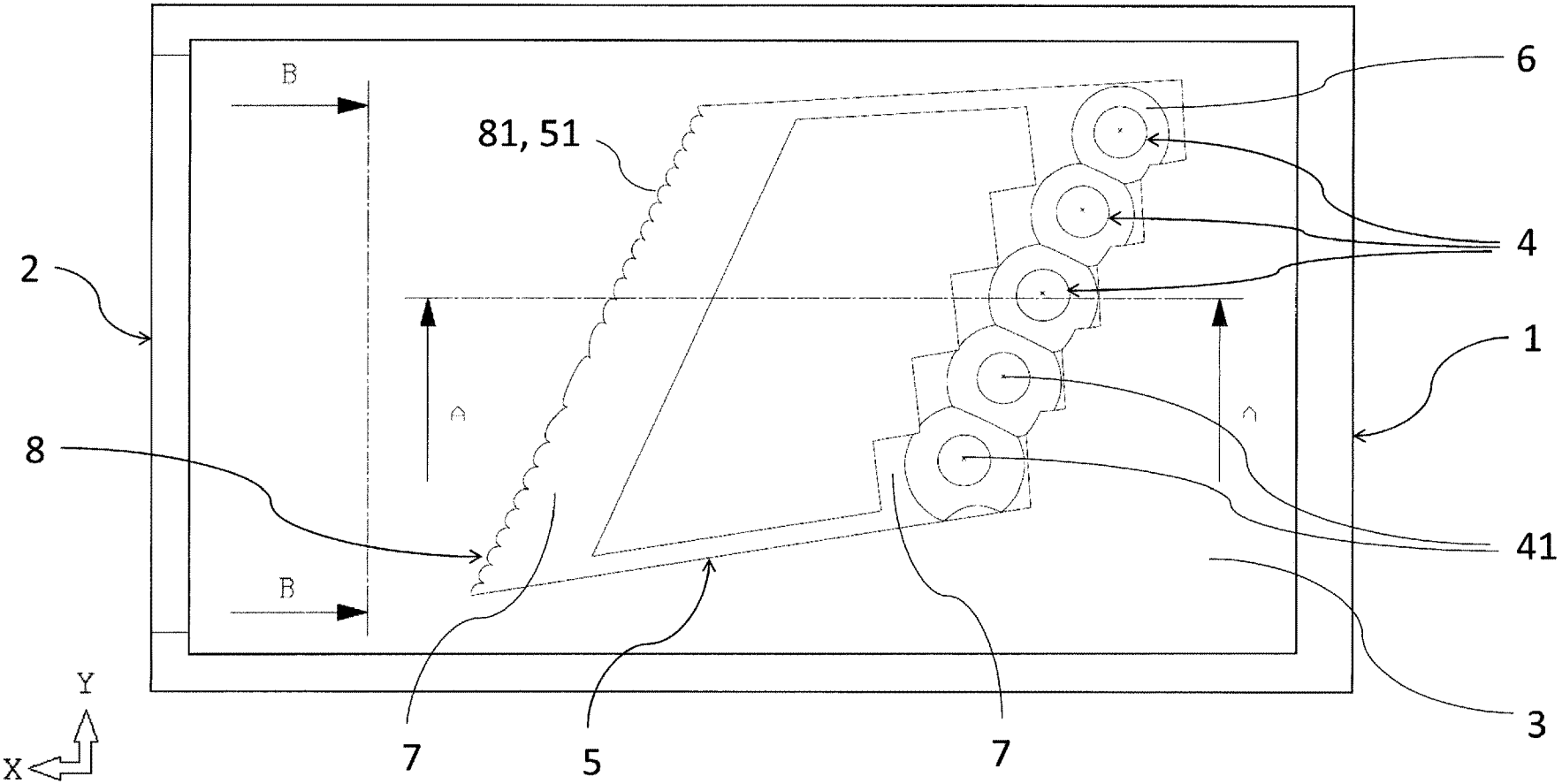

(51) Int. Cl.

| | |
|---|---|
| ***F21S 43/31*** | (2018.01) |
| ***F21S 43/241*** | (2018.01) |
| ***F21S 43/15*** | (2018.01) |
| ***F21S 43/40*** | (2018.01) |
| ***F21S 43/245*** | (2018.01) |
| ***F21S 43/14*** | (2018.01) |
| ***F21S 43/50*** | (2018.01) |
| ***F21S 43/251*** | (2018.01) |

(52) U.S. Cl.
CPC ..... *F21S 43/245* (2018.01); *F21S 43/251* (2018.01); *F21S 43/315* (2018.01); *F21S 43/40* (2018.01); *F21S 43/50* (2018.01)

(58) Field of Classification Search
CPC ..... F21S 43/15; F21S 43/245; F21S 43/50; B60Q 1/2607; B60Q 1/0058; F21V 5/002; G02B 5/021; G02B 5/0278
See application file for complete search history.

(56) References Cited

U.S. PATENT DOCUMENTS

| | | | | |
|---|---|---|---|---|
| 2013/0063961 | A1* | 3/2013 | Yamazaki | F21S 43/26 362/521 |
| 2015/0062952 | A1* | 3/2015 | Lessard | F21V 5/04 362/549 |
| 2015/0277027 | A1* | 10/2015 | Koizumi | B60Q 1/2607 362/511 |
| 2016/0195234 | A1 | 7/2016 | Mateju et al. | |

FOREIGN PATENT DOCUMENTS

| | | | |
|---|---|---|---|
| WO | 01/41455 | A1 | 6/2001 |
| WO | 2016/064205 | A1 | 4/2016 |

* cited by examiner

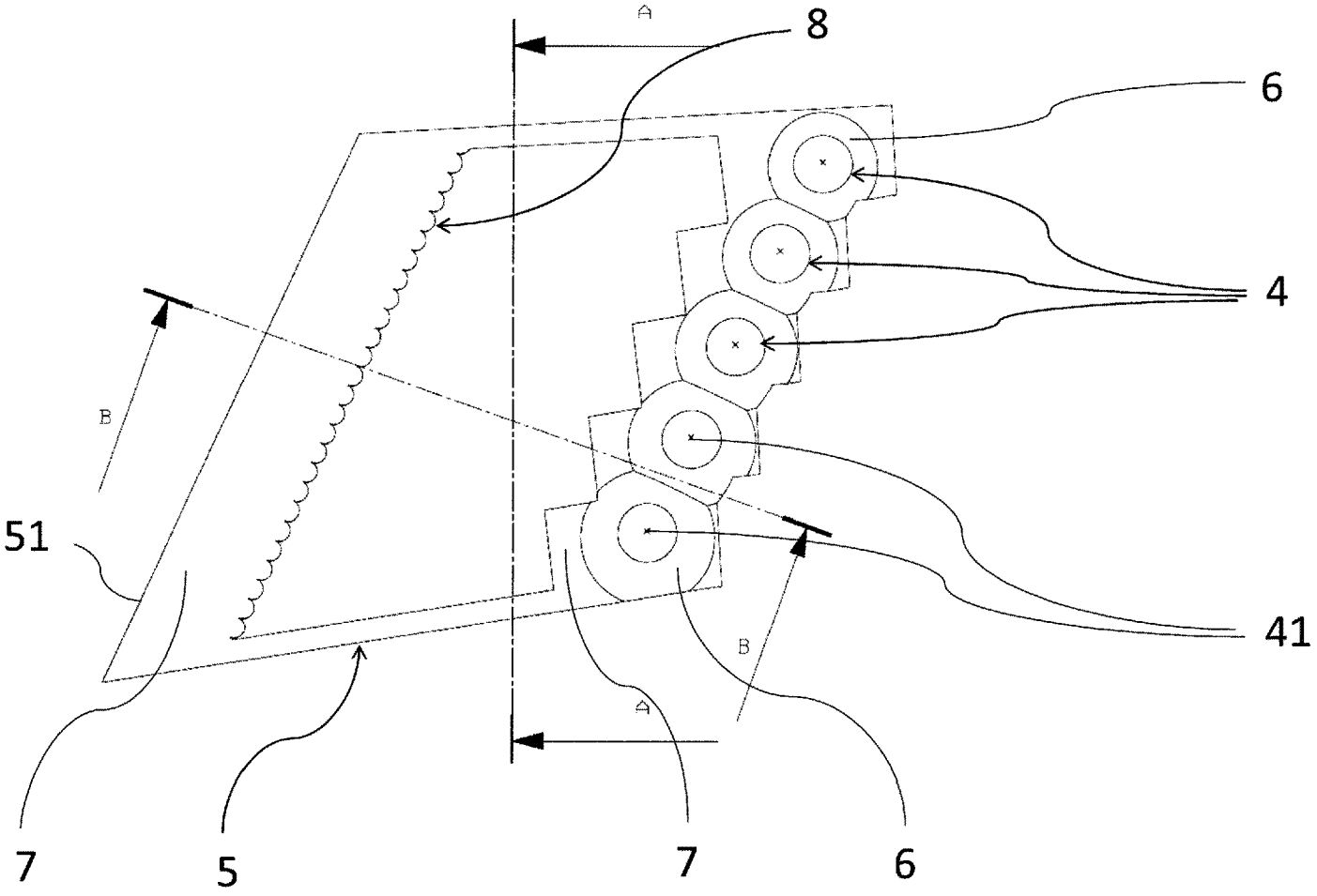
*Fig. 4*
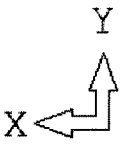

LIGHT DEVICE FOR MOTOR VEHICLES

FIELD OF THE INVENTION

The invention relates to a light device for motor vehicles whose emitted light beams create various patterns and spatial effects.

BACKGROUND INFORMATION

The primary task of light devices of motor vehicles is to light the carriageway or to emit light signal functions. However, at present there is an increasing focus on significantly higher involvement of headlights and signal lamps in the designer concept of the vehicle. Light devices should not only emit light with the required radiation characteristic, but at the same time they should participate in the character of the vehicle.

A light device of motor vehicles comprises at least one lighting unit ensuring, or contributing to ensuring the required emission characteristic of the light trace. Individual lighting units are generally mounted in a shaped carrying bushing of the lamp while each unit contains at least one light source and other optical elements. The light source emits light rays and the optical elements represent a system of refractive and reflective surfaces and interfaces of optical environments that influence the direction of light rays within the creation of the output light trace.

Lighting devices are known from the prior art that are adapted to create various patterns and spatial effects. E.g. the document EP1126209 discloses a lighting device comprising a light guiding optical element adapted to combine the light generated by two different light sources, the device making it possible to emit a different light pattern in the lit state. A disadvantage of the above-mentioned solution consists in limited designer options because designer requirements for the external appearance of the product cannot be met, e.g. it cannot actively create light patterns with a spatial effect in the lit state and in the off state, when the optical elements do not provide a spatial impression. Thus, 3D effects cannot be produced when the light source has been switched off.

The document CZ20150002 discloses the design of a signal lamp that comprises a spatially shaped light guide the parts of which, especially the output surfaces, overlap each other in the view of the inner space of the headlight, which makes it possible to produce a spatial effect, e.g. in the form of spatially arranged crystals, even after the light source being switched off. A disadvantage of this design is the fact that the spatially shaped light guide occupies a considerable installation space, is expensive to produce and does not allow more light functions to be combined.

The document WO2016/064205 discloses a lighting apparatus capable of providing three-dimensional effects at the same time as the surface emission of light sources by using a half-mirror member for reflecting and transmitting parts of light. In particular, by adopting the half-mirror member for transmitting a part of and reflecting another part of light emitted from a surface-emitting light source module, this device allows the implementation of a mirror-like image when the light is off, and allows the implementation of a light image providing various three-dimensional effects when the light is on.

The document WO0141455 discloses a soft edge plate for use in the projection of an image onto a viewing screen. It comprises a transparent area, an opaque area, and a semi-transparent area between said transparent area and said opaque area. The semi-transparent area comprises an alternating macroscopic pattern of discrete opaque and transparent areas. A soft edge plate with a pattern as described above, applied in metal on a glass substrate, may in particular be used for soft edging LCD projectors.

The object of the invention is to design a light device, especially a signal lamp for motor vehicles, that can be adapted to designer requirements for the external appearance of the product, wherein the light device should, besides emitting light, participate in the designer character of the vehicle while in the off state, such that the spatial impression should be maintained.

Principle of the Invention

The above-mentioned objects of the invention are met and disadvantages of the prior art are eliminated by a light device for motor vehicles, especially a signal lamp, according to the invention, comprising a carrier housing, covered by a translucent cover, and an inner chamber wherein at least one light source for generating light rays is mounted. Also included is a transparent optical part with at least one output surface for the output of at least a part of light rays from the transparent optical part, the principle of which is that it comprises at least one macrotexture the surface of which includes individual surfaces designed for transmission and/or reflection of a part of light rays. The macrotexture and the transparent optical part are arranged in such a way that in a view of the inner chamber towards the output surface through the translucent cover from the outside of the light device, the impression of a spatial effect is produced, which is even visible with the light source being off.

In one of the embodiments, at least one of the macrotextures is created in the form of one or more macrotexture bodies. The macrotexture body can have an essentially planar shape.

In another one of the embodiments, the macrotexture body is positioned outside the transparent optical part in such a way that it is in contact with the output surface of the transparent optical part.

In another one of the embodiments, the macrotexture body is positioned outside the transparent optical part and at a distance from its output surface.

In another one of the embodiments, the macrotexture body is positioned inside the transparent optical part.

In another one of embodiments, the macrotexture body is an integral part of the transparent optical part.

In one of the embodiments, the transparent optical part comprises at least one light-guiding element designed to guide light rays inside the transparent optical part.

In one of the embodiments, the at least one macrotexture comprises at least one unbinding surface configured to unbind light rays passing through the unbinding surface to another part of the transparent optical part and/or out of the transparent optical part.

In another one of the embodiments, the at least one macrotexture comprises at least one binding surface to bind light rays passing through the binding surface to other parts of the light device.

In another one of the embodiments, the at least one macrotexture comprises at least one reflective surface adapted to reflect light rays falling onto the reflective surface. The reflective surfaces of the macrotexture are can be geometrically arranged for uneven output of light rays from the output surface of the transparent optical part, to produce the impression of brighter and darker areas in a view of the inner chamber towards the output surface through the translucent cover.

The transparent optical part can be produced as a compact casting.

In one of the embodiments, in the propagation direction of the light rays generated by the light source before the transparent optical part, an optical element is arranged to route the light rays to the required direction.

The transparent optical part can comprise collimating elements or other optical elements to route light rays to the required direction.

OVERVIEW OF FIGURES IN THE DRAWINGS

Figure 2:
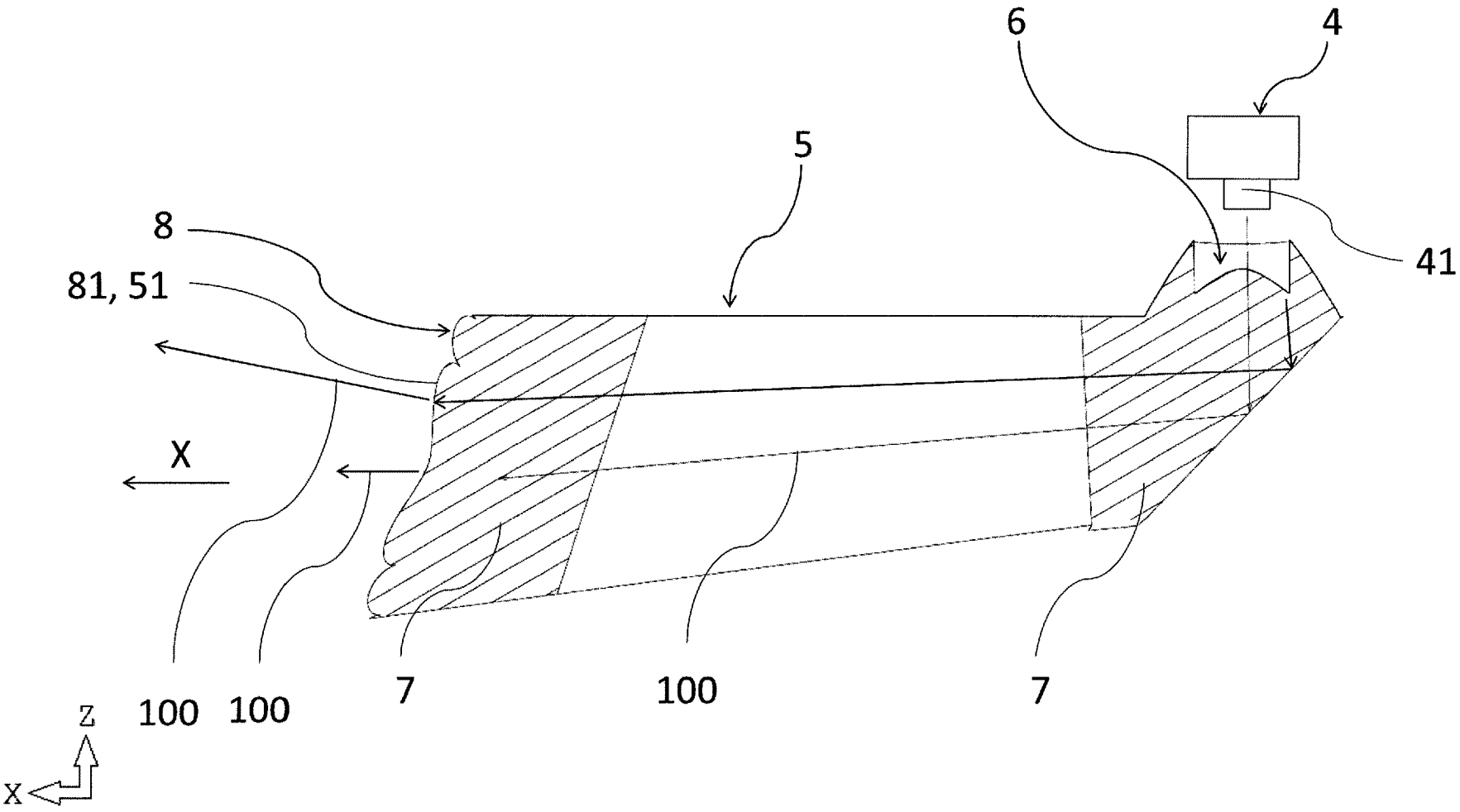
Figure 3:
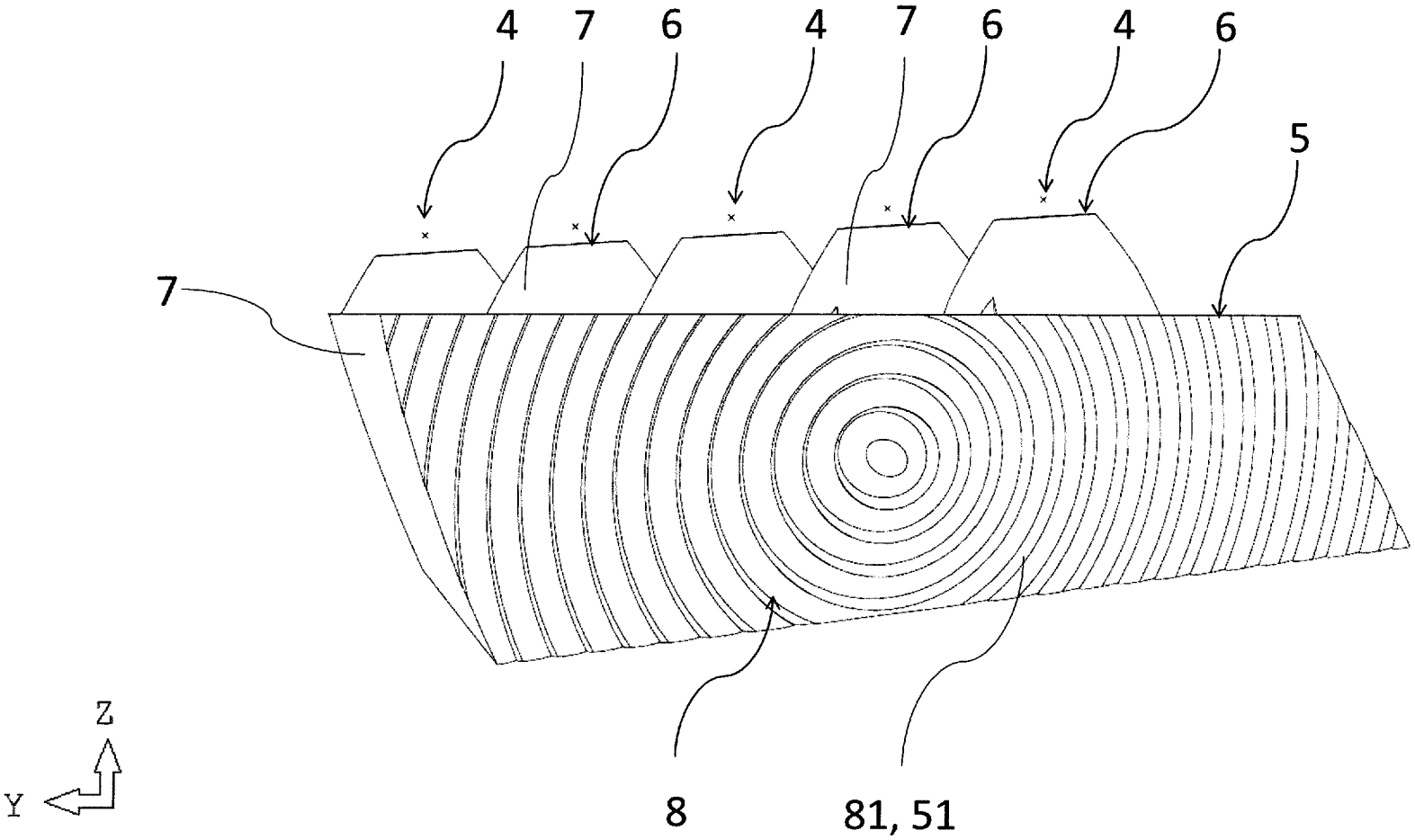
Figure 5:
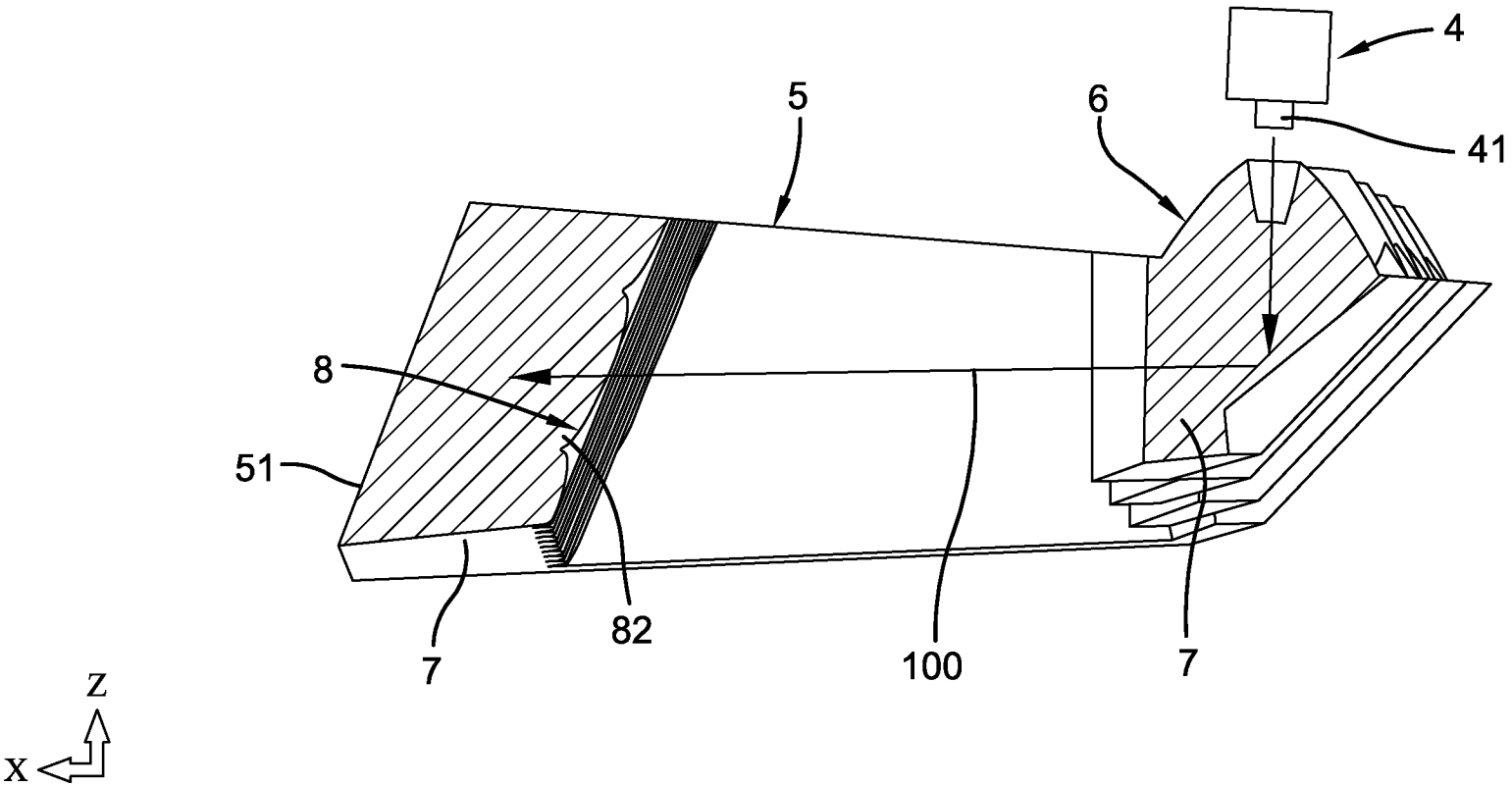
Figure 6:
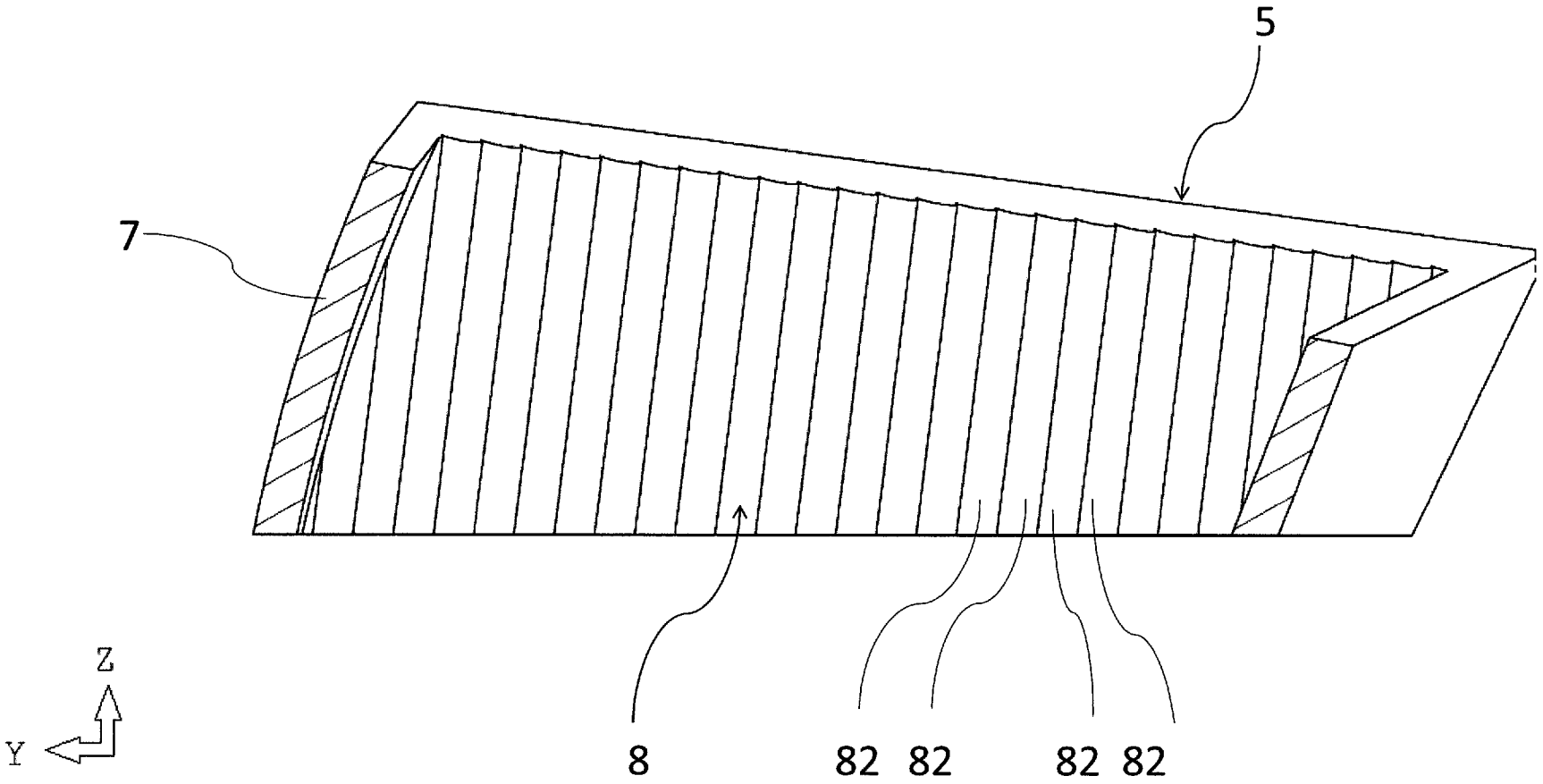
Figure 7:
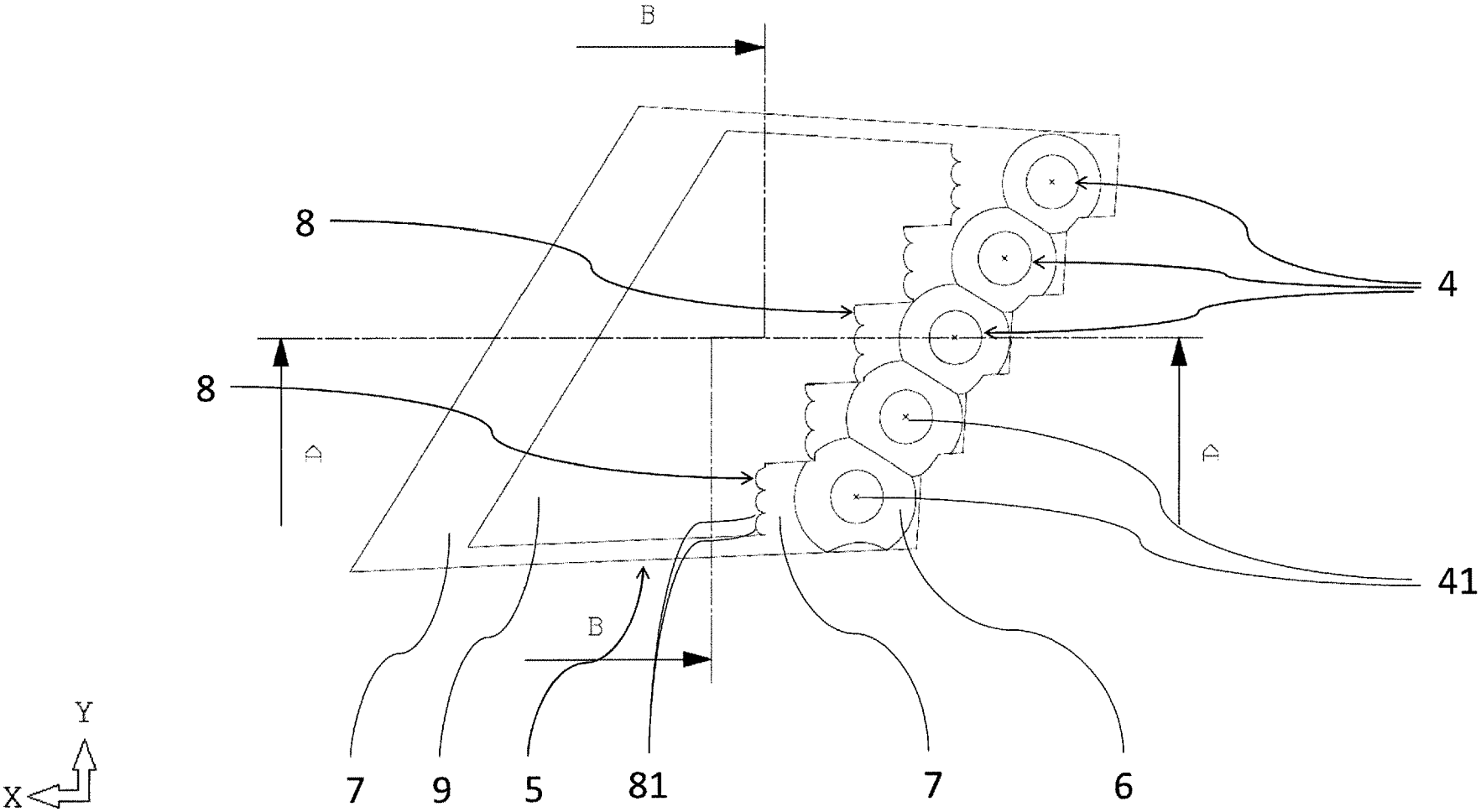
Figure 8:
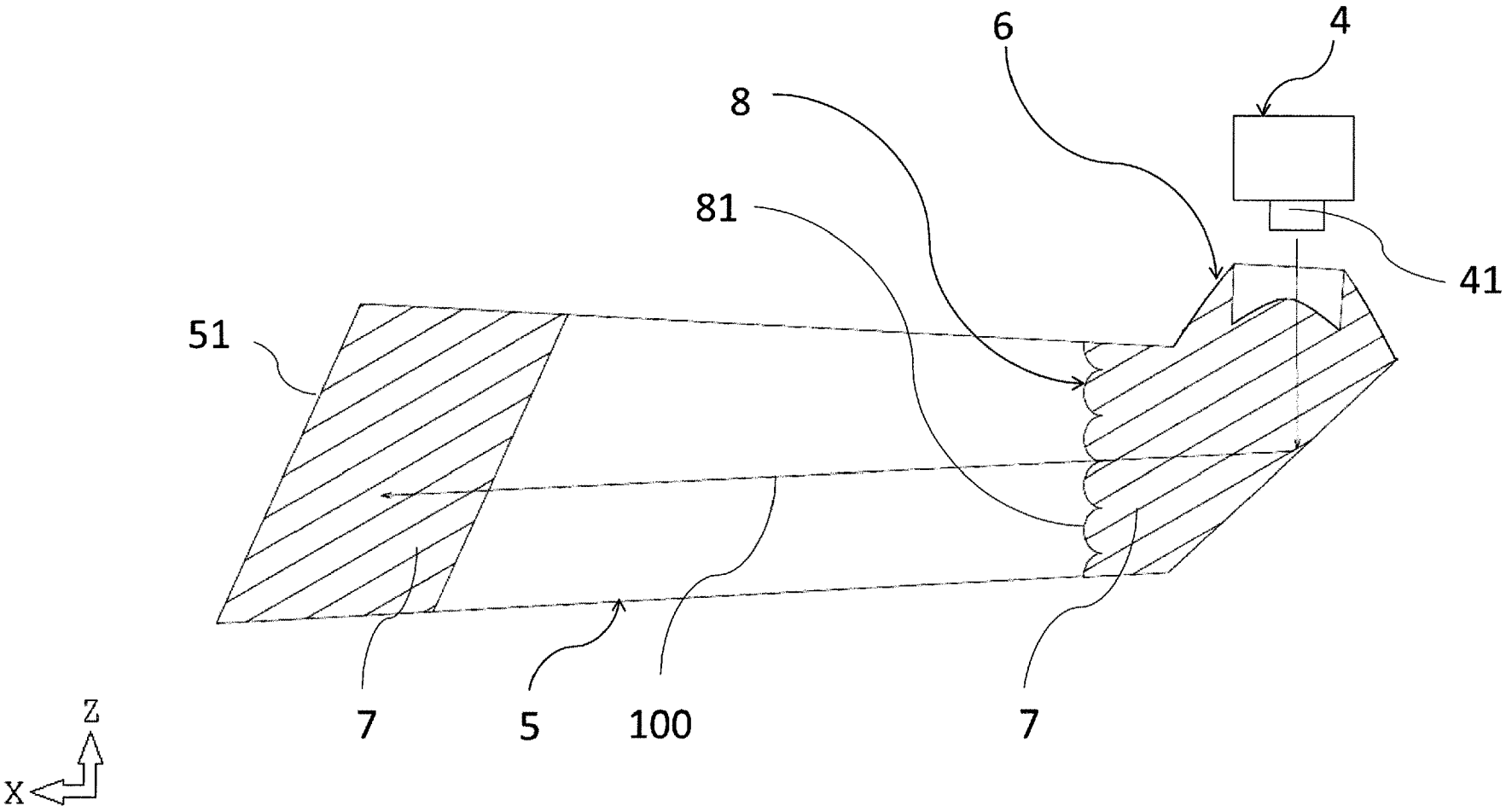
Figure 9:
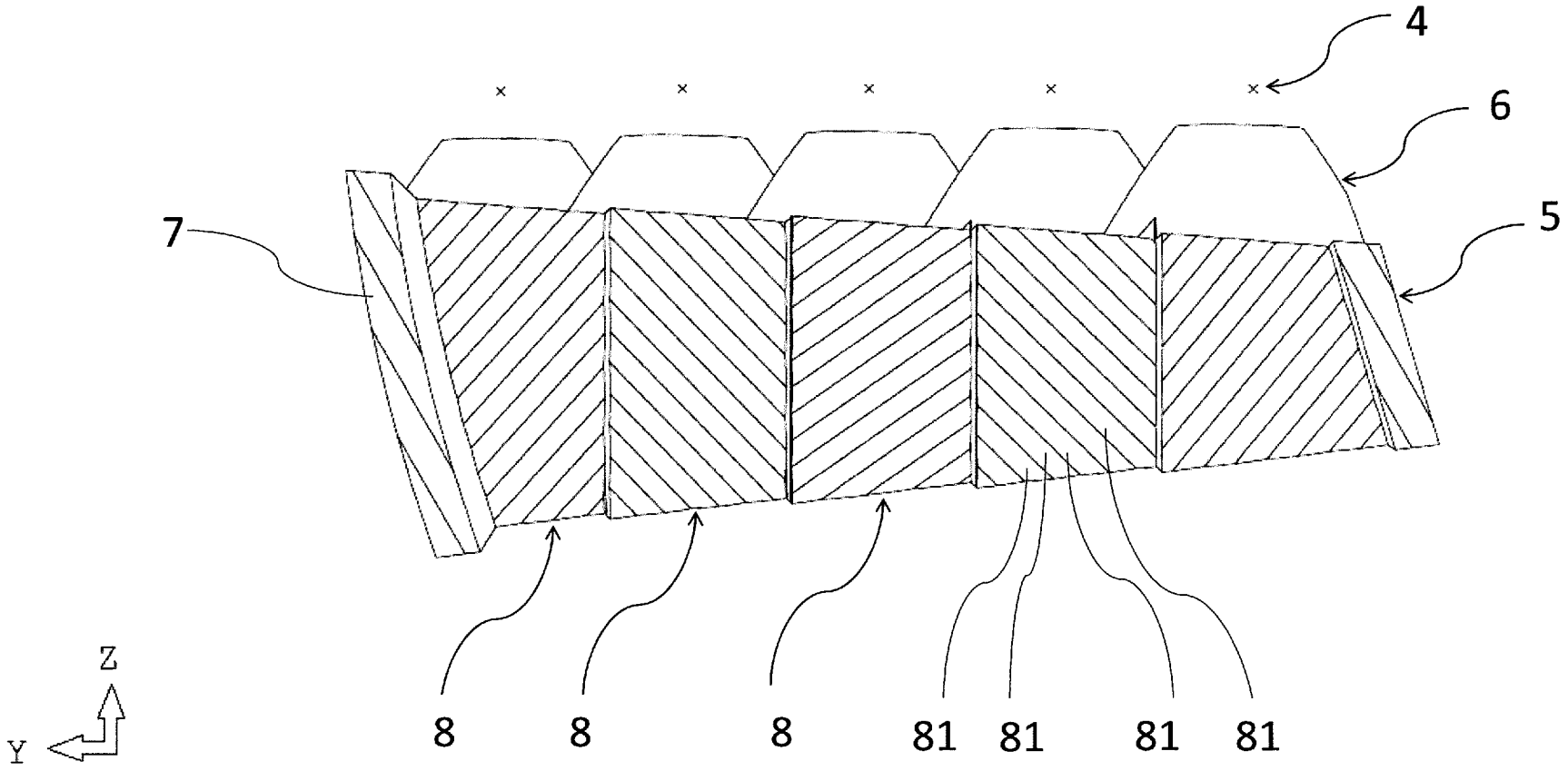
Figure 10:
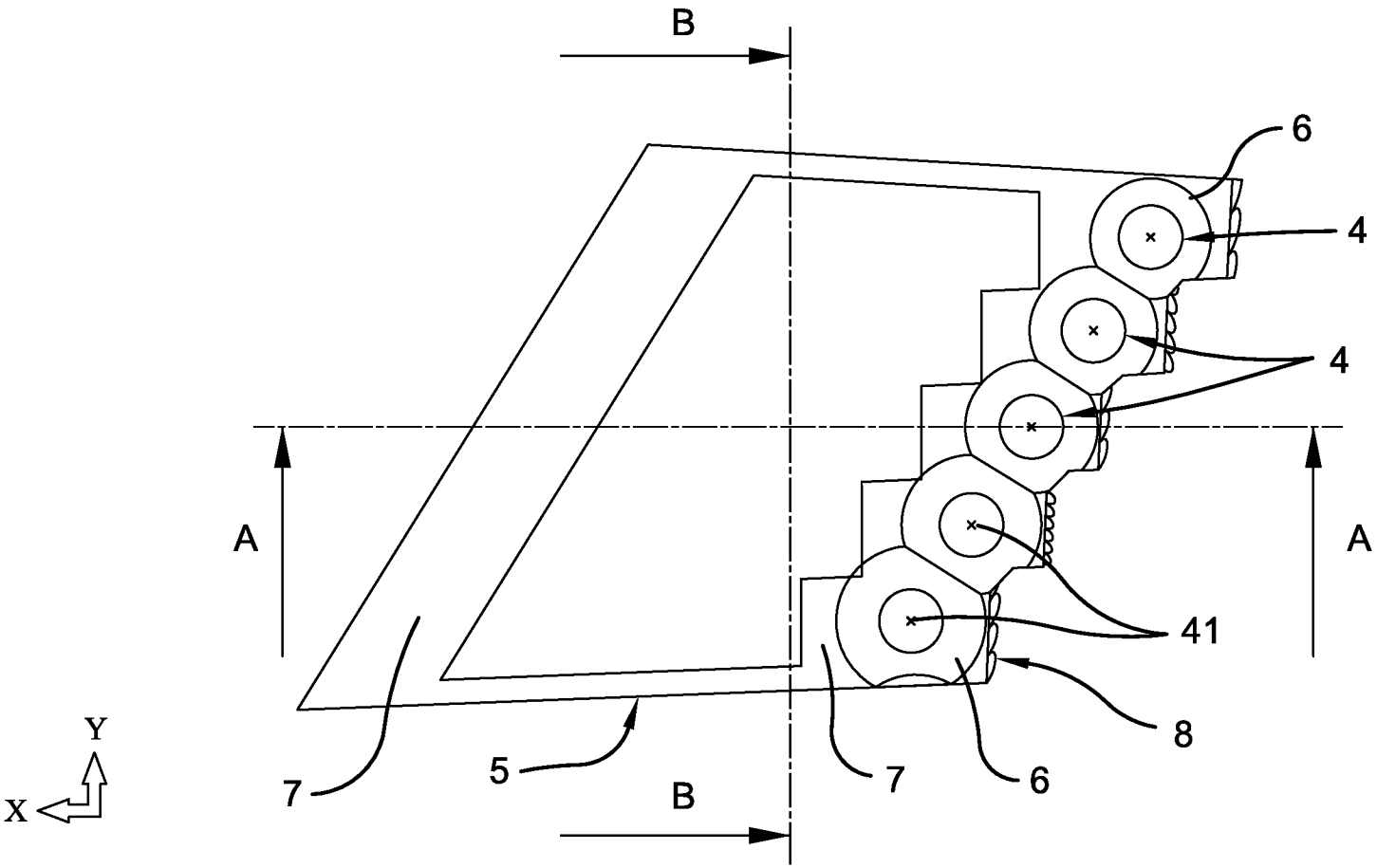
Figure 11:
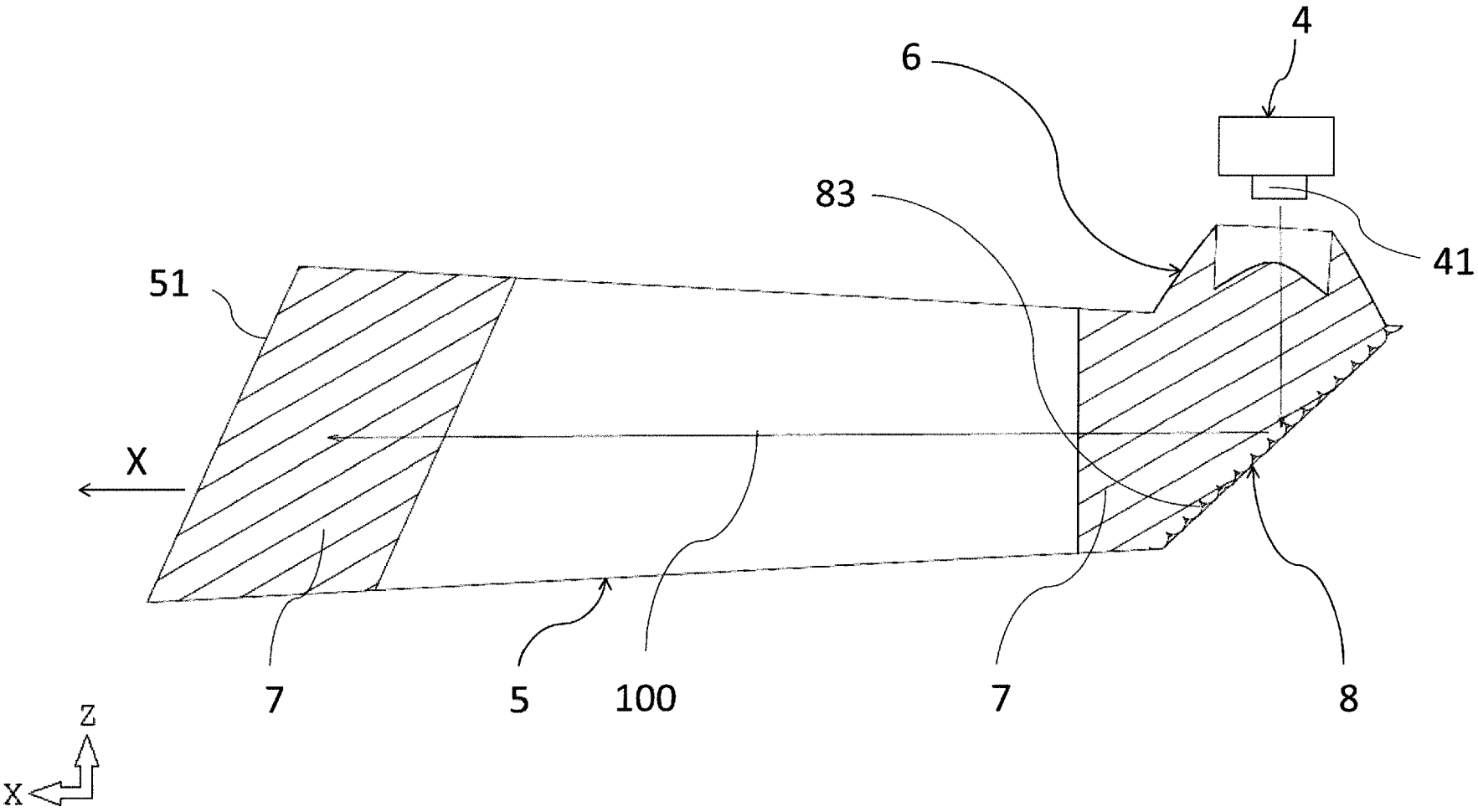
Figure 12:
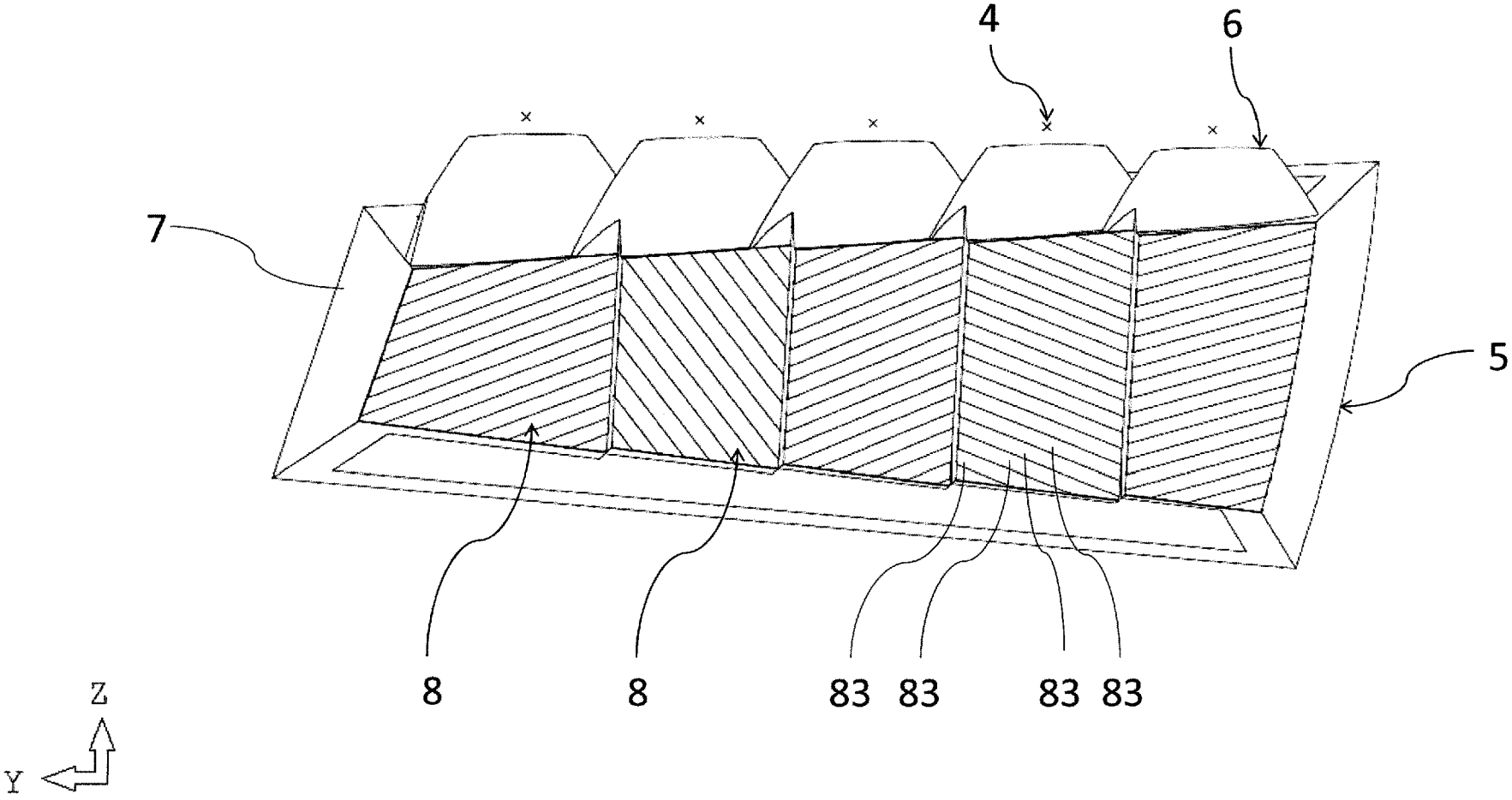
Figure 13:
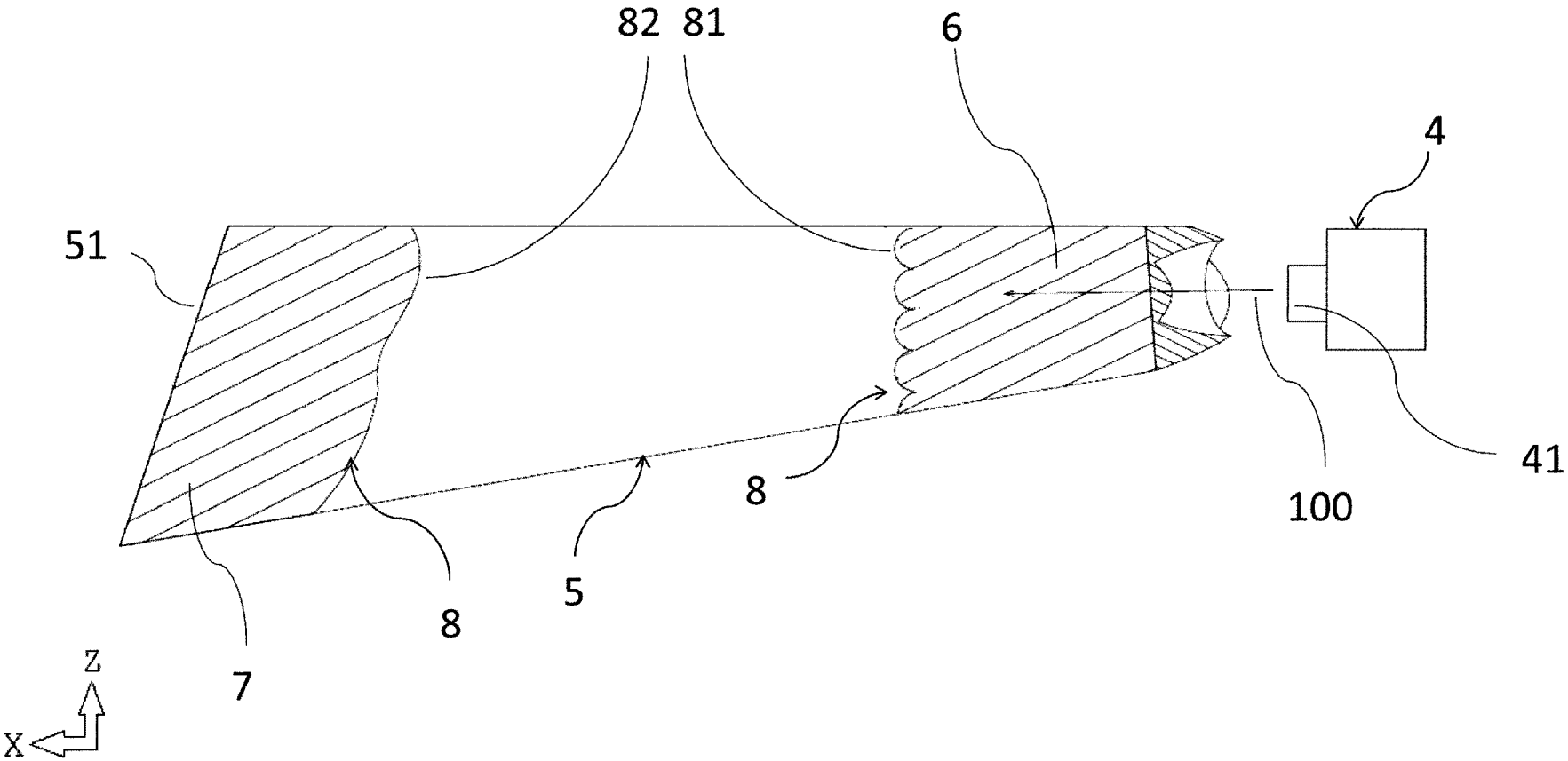
Figure 14:
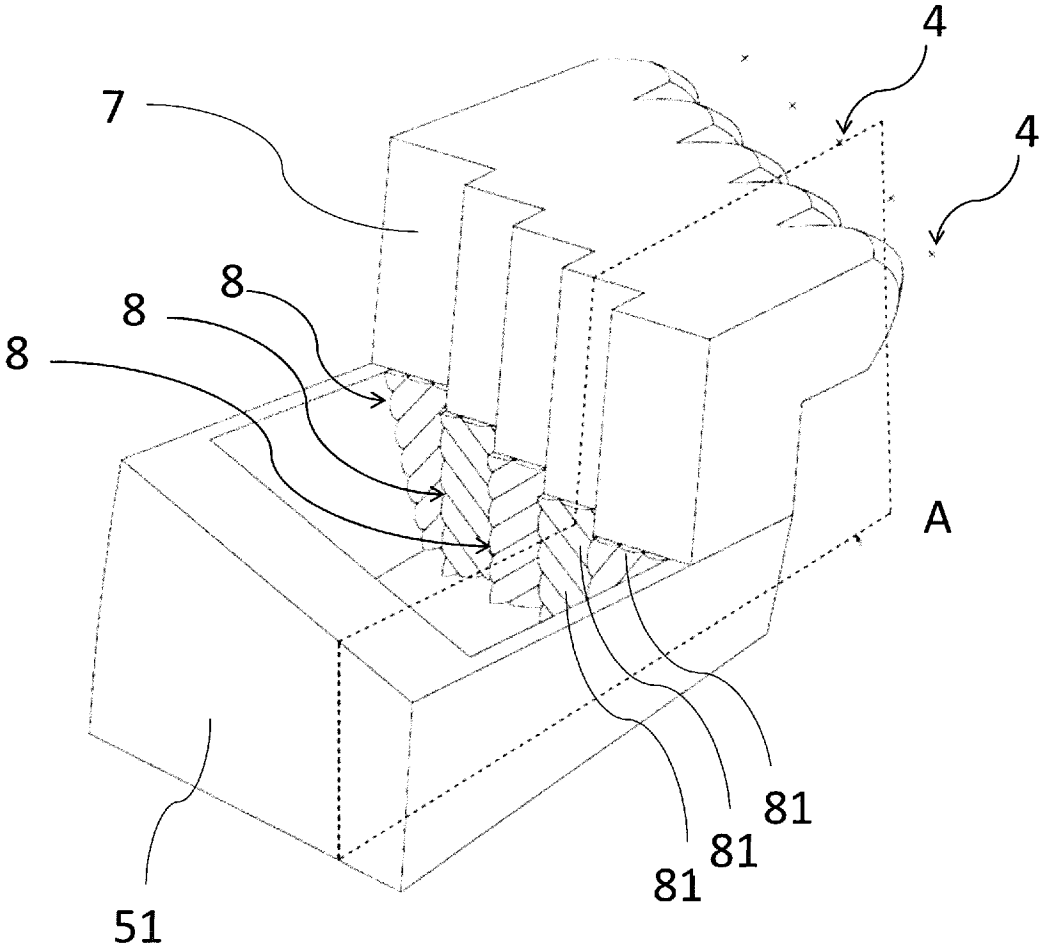
Figure 15:
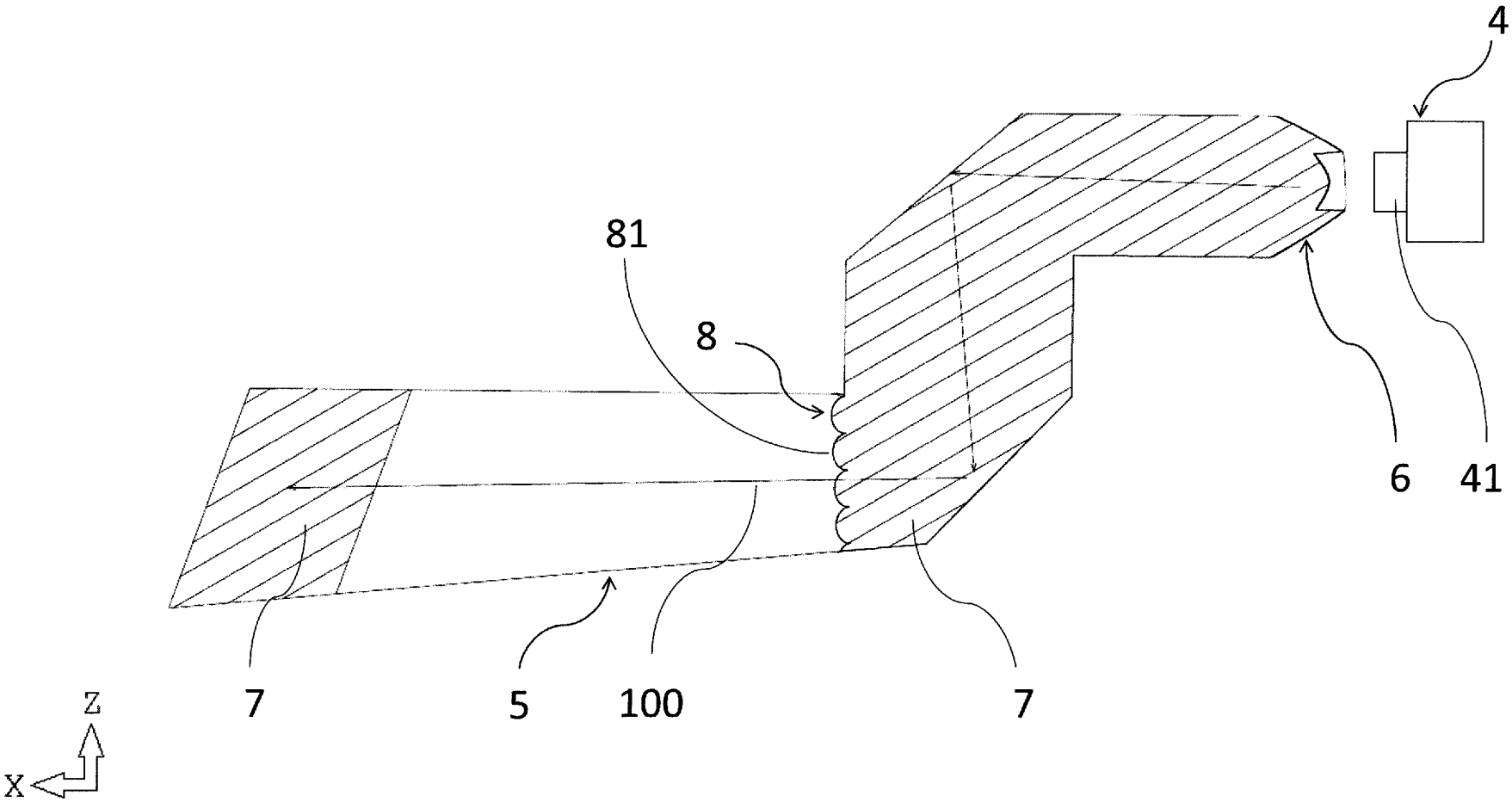
Figure 16:
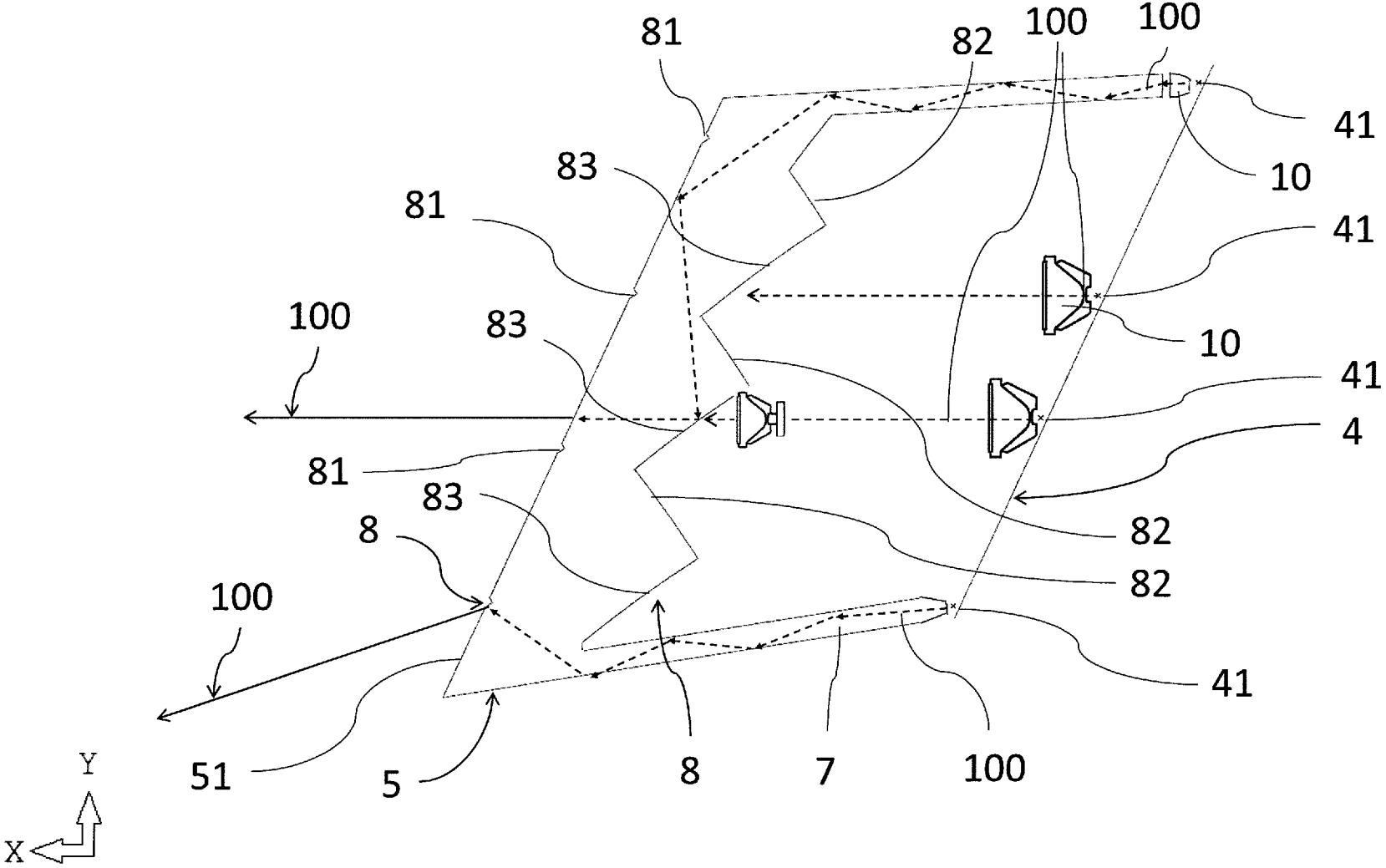
Figure 17:
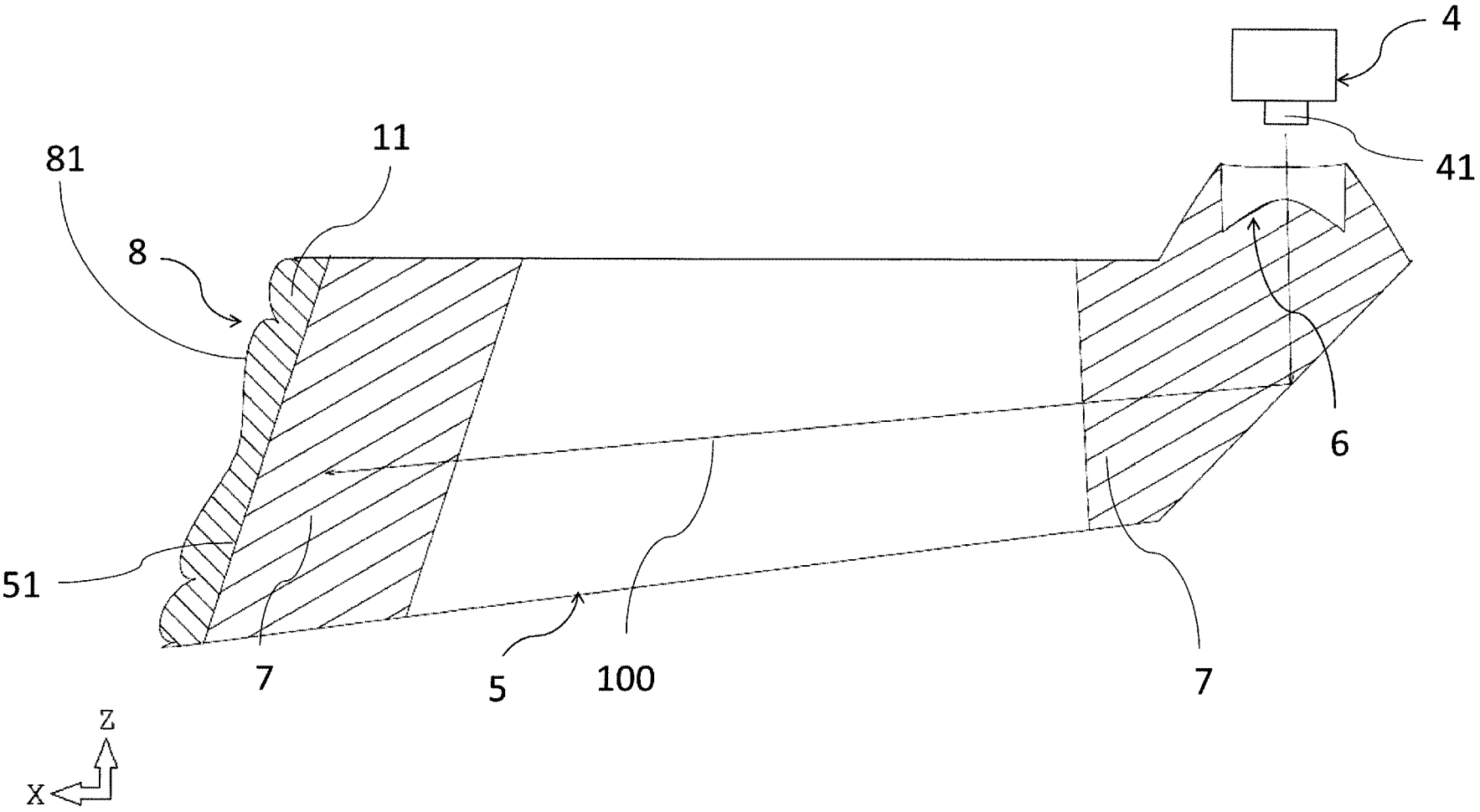
Figure 18:
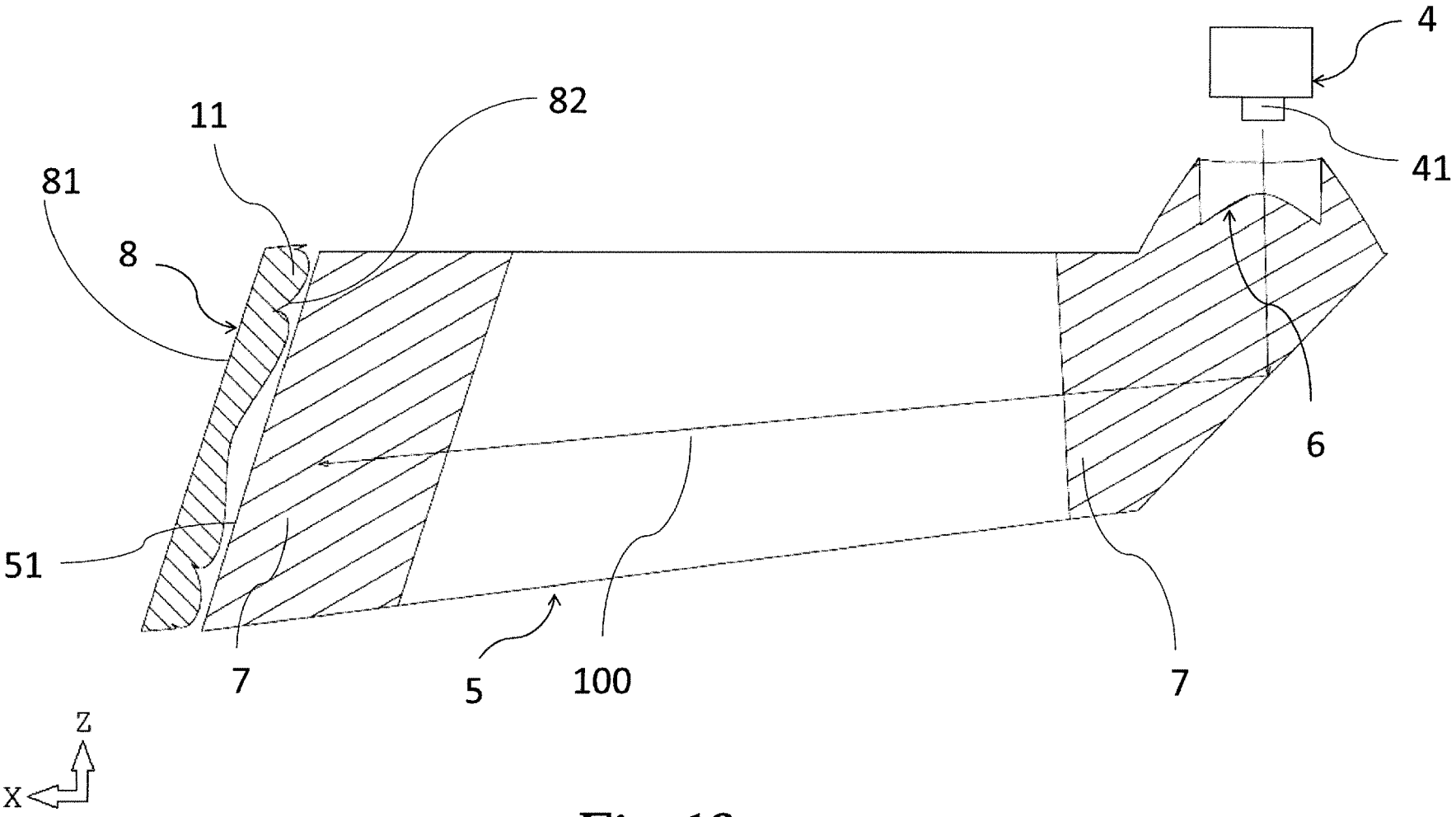
Figure 19:
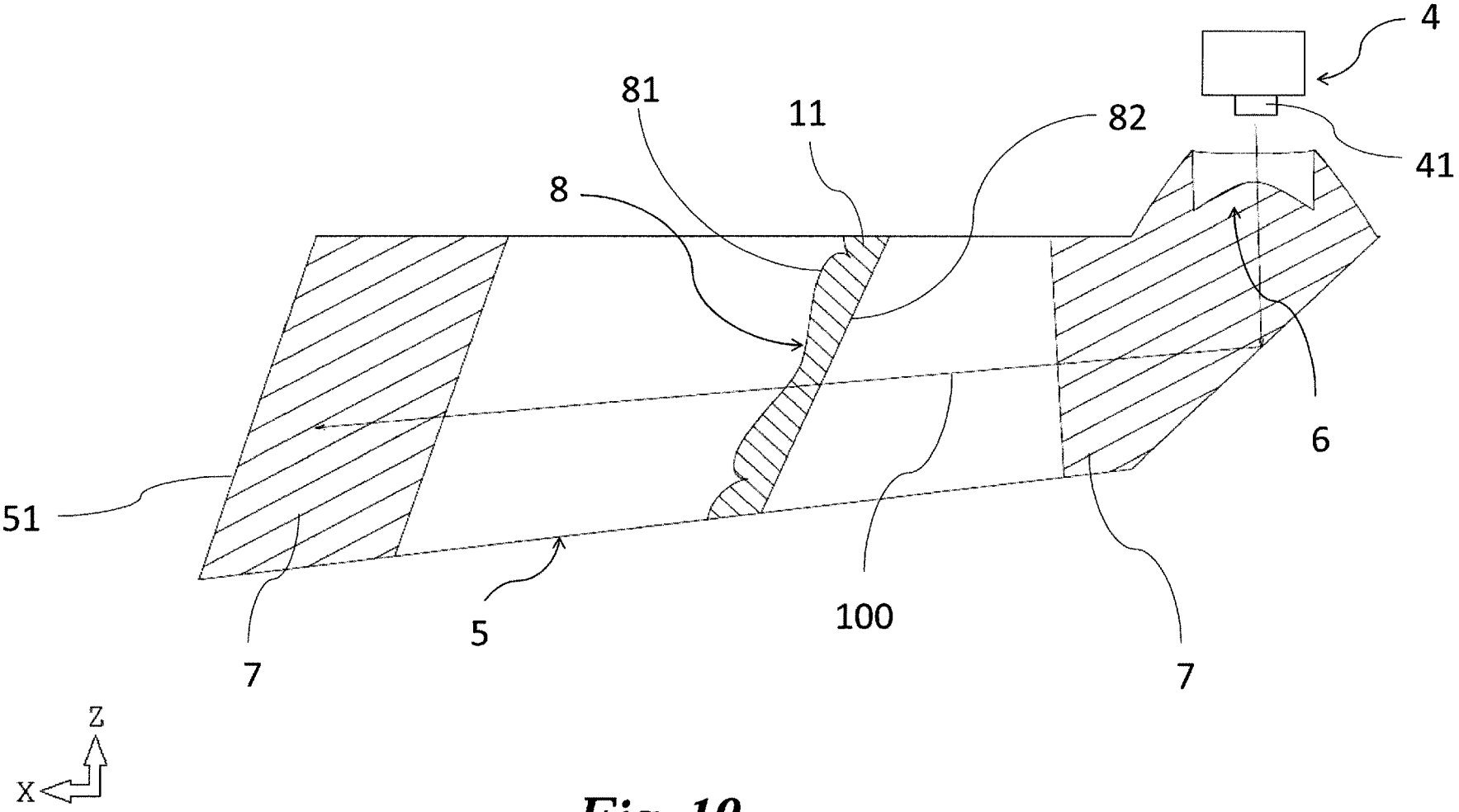
Figure 20:
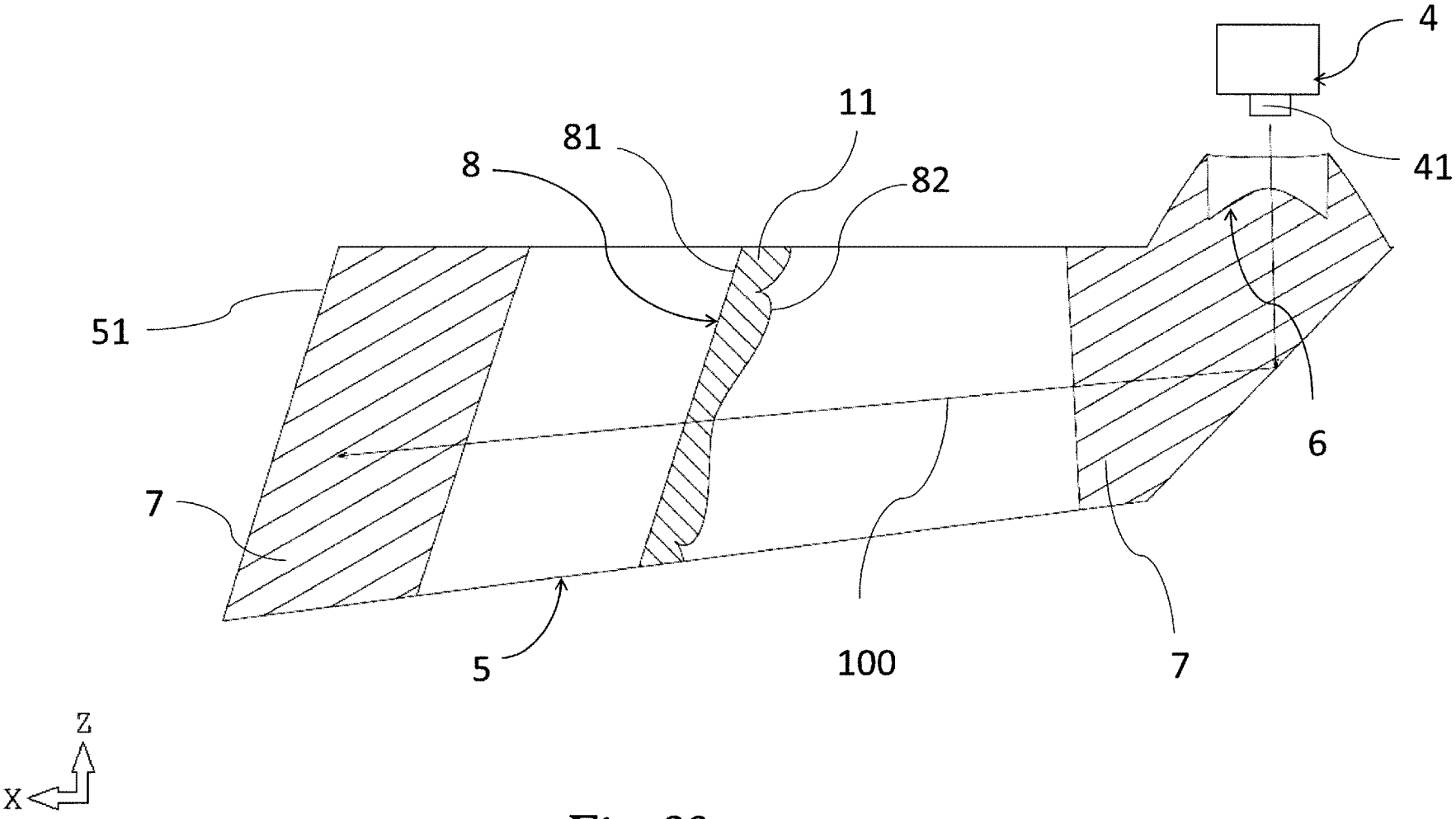

The invention will be clarified in a more detailed way with the use of its embodiment examples with references to attached drawings, where:

FIG. 1 shows a horizontal cross-section through a first embodiment example of the light device according to the invention, FIG. 2 shows a longitudinal cross-section through the light device of FIG. 1, taken along the line A-A in FIG. 1, FIG. 3 shows a sectional view of the light device of FIG. 1, taken along the line B-B in FIG. 1, FIG. 4 shows a horizontal cross-section through a second embodiment example of the light device, FIG. 5 shows a longitudinal cross-section through the light device of FIG. 4, taken along the line A-A of FIG. 4, FIG. 6 shows a sectional view of the light device of FIG. 4, taken along the line B-B of FIG. 4, FIG. 7 shows a horizontal cross-section through a third embodiment example of the light device, FIG. 8 shows a longitudinal cross-section through the light device of FIG. 7, taken along the line A-A of FIG. 7, FIG. 9 shows a sectional view of the light device of FIG. 7, taken along the line B-B of FIG. 7, FIG. 10 shows a horizontal cross-section through a fourth embodiment example of the light device, FIG. 11 shows a longitudinal cross-section through the light device of FIG. 10, taken along line A-A of FIG. 10, FIG. 12 shows a sectional view of the light device of FIG. 10, taken along the line B-B of FIG. 10, FIG. 13 shows a transversal cross-section through a fifth embodiment example of the light device, FIG. 14 shows an axonometric view of a sixth embodiment example of the light device, FIG. 15 shows a longitudinal cross-section on plane A through the light device of FIG. 14, FIG. 16 shows a horizontal cross-section through a seventh embodiment example of the light device, FIG. 17 shows a longitudinal cross-section through an eighth embodiment example of the light device, FIG. 18 shows a longitudinal cross-section through a ninth embodiment example of the light device, FIG. 19 shows a longitudinal cross-section through a tenth embodiment example of the light device, and FIG. 20 shows a longitudinal cross-section through an eleventh embodiment example of the light device.

EXAMPLES OF EMBODIMENTS

With reference to FIG. 1, FIG. 2, and FIG. 3, the first example of an embodiment of the light device according to the invention comprises a shaped carrier housing 1 forming the inner chamber 3 of the light device, which is covered by a translucent cover 2. In the inner chamber 3, lighting units 4 adapted to emit light rays 100 and a spatially shaped transparent optical part 5 are mounted, the transparent optical part comprising collimating elements 6 or other optical elements for collimation of light rays 100, light-guiding elements 7 designed to guide light rays 100 inside the transparent optical part 5 and an externally situated surface macrotexture 8 to ensure the required emission characteristic of the light trace, the macrotexture 8 being adapted to create a plastic pattern in the optical surface, e.g. a designer element in the form of a light-emitting pattern. Within the body of the light-guiding element 7, light rays 100 are routed and guided towards the translucent cover 2 on the one hand, and light is unbound in the required direction with the required output characteristics of the light beam on the other hand. In this embodiment, the unbinding surfaces 81 of the macrotexture 8 at the same time represent the output surfaces 51 of the transparent optical part 5, light rays 100 being diverted from the direction X, which produces areas with a different light intensity and a 3D effect/plastic pattern is produced in the view of the inner chamber 3. The 3D effect and/or plastic pattern are also maintained when the light source 41 of the lighting unit 4 is off.

According to FIG. 4, FIG. 5 and FIG. 6, a second example of an embodiment of the light device according to the invention comprises a spatially shaped transparent optical part 5 with an output surface 51, which comprises collimating elements 6 adapted to collimate light rays 100, light-guiding elements 7 designed to guide light rays 100 inside the transparent optical part 5, and an inwardly oriented surface macrotexture 8 adapted with its binding surfaces 82 to bind light rays 100 into the light-guiding element 7.

FIG. 7, FIG. 8 and FIG. 9 show a third example of an embodiment of the light device, wherein the spatially shaped transparent optical part 5 comprises five surface macrotextures 8 arranged next to each other, which light rays 100 exit from, the unbinding surfaces 81 being oriented towards a closed chamber 9 created in the transparent optical part 5.

FIG. 10, FIG. 11 and FIG. 12 show a fourth example of an embodiment of the light device, wherein the spatially shaped transparent optical part 5 comprises light-guiding elements 7 fitted with a macrotexture 8 adapted with its reflective surfaces 83 to reflect light rays 100 into the light-guiding element 7.

FIG. 13 shows a fifth example of an embodiment of the light device, wherein the spatially shaped transparent optical element 5 is fitted with two separate macrotextures 8 arranged in the propagation direction of the rays one after another, wherein the first macrotexture 8 is situated on the light-guiding element 7 and is adapted with its binding surface 82 to bind light rays 100, and the other macrotexture 8 is created on the collimating element 6 and is adapted to unbind light rays 100 through the unbinding surface 81.

FIG. 14 and FIG. 15 show a sixth example of an embodiment of the light device, wherein the spatially shaped transparent optical part 5 is fitted with five separate macrotextures 8 situated on the spatially shaped light-guiding element 7 adapted to guide and route light rays 100.

FIG. 16 shows a seventh example of an embodiment of the light device, wherein the spatially shaped transparent optical part 5 is designed as a compact casting. The transparent optical part 5 consists of the light-guiding element 7, which is fitted with two macrotextures 8. The first, outwardly oriented, macrotexture 8 is implemented as a diffusion element and with its unbinding surfaces 81 it is adapted to emit a diverted/diffused beam of light rays 100. The other macrotexture 8, oriented towards the light source 41, is fitted with binding surfaces 82 and reflective surfaces 83, wherein the binding surfaces 82 are adapted to bind and guide at least a part of light rays 100 generated by at least one of the light sources 41 of the lighting unit 4 while by means of geometrically arranged reflective surfaces 83 light rays are directed in such a way to ensure uneven unbinding of light rays from the output surface 51 of the transparent optical part 5. Thus, in the lit state, a plastic pattern is created when in the optical display surface various light areas are produced with different light intensities and/or with different propagation directions of light rays to create the light/shade contract or to create brighter and darker areas in the display surface. In the propagation direction of light rays 100, before the transparent optical part 5, an optical element 10 is arranged to route light rays 100 to the required direction, the optical element 10 being implemented e.g. as a separate collimating element or an optical lens or light guide.

FIGS. 17 to 20 show eighth to eleventh examples of embodiments of the light device according to the present invention, which are different from the previous embodiments described above, in that at least one of the macrotextures 8 is created on a separate body 11 that preferably has an essentially flat shape. An advantage of such a solution is that with a particular design of the transparent optical part 5 and/or light-guiding element 7, differently configured bodies 11 and their placing in various positions can be used to achieve principally different light effects produced by the light device without variously shaped transparent parts 5 or light-guiding elements 7 having to be produced in a costly manner. The advantage of the above mentioned essentially flat shape of the body 11 is that with such a shape of the body 11 this body 11 occupies minimal space.

FIG. 17 particularly shows an eighth example of an embodiment of the device according to the invention, wherein the body 11 fitted with a macrotexture 8 is positioned adjacent to the output surface 51 of the transparent optical part 5, the macrotexture comprising an unbinding surface 81.

FIG. 18 shows a ninth example of an embodiment of the light device according to the present invention, wherein the body 11 fitted with a macrotexture 8 is positioned on the output surface 51 or near the output surface of the transparent optical part 5 in such a way that the macrotexture 8 faces the transparent optical part 5 with its binding surface 82, and its unbinding surface 81 faces away from the transparent optical part 5.

FIG. 19 shows a tenth example of an embodiment of the light device according to the present invention, wherein the body 11 fitted with a macrotexture 8 is positioned inside the transparent optical part 5 in the space between its two light-guiding elements 7 and the macrotexture 8 comprises an unbinding surface 81 and a binding surface 82.

FIG. 20 shows an eleventh example of an embodiment of the light device according to the present invention, which is very similar to the previous example, differing from it however with the shape design of the unbinding surface 81 and binding surface 82.

LIST OF REFERENCE MARKS

1—carrier housing
2—translucent cover
3—inner chamber
4—lighting unit
41—light source
5—transparent optical part
51—output surface
6—collimating element
7—light-guiding element
8—macrotexture
81—unbinding surface
82—binding surface
83—reflective surface
9—chamber
10—optical element
11—(macrotexture) body
100—light ray
X, Y, Z—coordinate axes of the Cartesian coordinate system

The invention claimed is:

1. A light device for motor vehicle signal lamps, comprising a carrier housing, covered by a transparent or translucent cover, and an inner chamber wherein at least one light source for generating light rays is mounted, and a transparent optical part different from the cover with at least one output surface for the output of at least a part of light rays from the transparent optical part, wherein the light device comprises at least one macrotexture the surface of which consists of individual surfaces designed for transmission and/or reflection of a part of light rays, the macrotexture and the transparent optical part being arranged, to form the spatial light images visible from outside looking at the light device even with the light source being off, wherein at least one of the macrotexture is created in the form of a macrotexture body different from the cover and from the transparent optical part, wherein the macrotexture body is deposited between the cover and the output surface in such a way that it is in contact with the at least one output surface in contact points, wherein at least a part of light rays exiting the output surface in the direction to cover passes through at least some of the contact points.

2. The light device in accordance with claim 1, wherein a macrotexture body essentially has a planar shape.

3. The light device in accordance with claim 1, wherein a macrotexture body is positioned outside the transparent optical part and at a distance from its output surface.

4. The light device in accordance with claim 1, wherein a macrotexture body is positioned inside the transparent optical part.

5. The light device in accordance with claim 1, wherein the transparent optical part comprises at least one light-guiding element designed to guide light rays inside the transparent optical part.

6. The light device in accordance with claim 1, wherein the at least one macrotexture comprises at least one unbinding surface configured to unbind light rays passing through the unbinding surface to another part of the transparent optical part and/or out of the transparent optical part.

7. The light device in accordance with claim 1, wherein the at least one macrotexture comprises at least one binding surface to bind light rays passing through the binding surface to other parts of the light device.

8. The light device in accordance with claim 1, wherein the at least one macrotexture comprises at least one reflective surface adapted to reflect light rays falling onto the reflective surface.

9. The light device in accordance with claim 8, wherein the reflective surfaces of the macrotexture are preferably geometrically arranged for uneven output of light rays from the output surface of the transparent optical part to produce the light image including brighter and darker areas, wherein the light image is visible from the outside looking at the light device.

10. The light device in accordance with claim 1, wherein the transparent optical part is created as a compact casting.

11. The light device in accordance with claim 1, wherein in a propagation direction of the light rays generated by the light source, an optical element for routing the light rays to a required direction is arranged before the transparent optical part.

12. The light device in accordance with claim 1, wherein the transparent optical part comprises collimating elements or other optical elements to route light rays to a required direction.

13. A light device for motor vehicle signal lamps, comprising a carrier housing, covered by a transparent or translucent cover, and an inner chamber wherein at least one light source for generating light rays is mounted, and a transparent optical part different from the cover with at least one output surface for the output of at least a part of light rays from the transparent optical part, wherein the light device comprises at least one macrotexture the surface of which consists of individual surfaces designed for transmission and/or reflection of a part of light rays, the macrotexture and the transparent optical part being arranged, to form the spatial light images visible from outside looking at the light device even with the light source being off, wherein at least one of the macrotexture is created in the form of a macrotexture body different from the cover and from the transparent optical part, wherein the transparent optical part comprises two light-guiding elements that are designed to guide light rays inside the transparent optical part and form between themselves a space in which the macrotexture body is deposited.

14. The light device in accordance with claim 13, wherein the at least one macrotexture comprises at least one unbinding surface configured to unbind light rays passing through the unbinding surface to another part of the transparent optical part and/or out of the transparent optical part.

15. The light device in accordance with claim 13, wherein the at least one macrotexture comprises at least one binding surface to bind light rays passing through the binding surface to other parts of the light device.

16. The light device in accordance with claim 13, wherein the at least one macrotexture comprises at least one reflective surface adapted to reflect light rays falling onto the reflective surface.

17. The light device in accordance with claim 16, wherein the reflective surfaces of the macrotexture are preferably geometrically arranged for uneven output of light rays from the output surface of the transparent optical part to produce the light image including brighter and darker areas, wherein the light image is visible from the outside looking at the light device.

18. The light device in accordance with claim 13, wherein the transparent optical part is created as a compact casting.

19. The light device in accordance with claim 13, wherein in a propagation direction of the light rays generated by the light source, an optical element for routing the light rays to a required direction is arranged before the transparent optical part.

20. The light device in accordance with claim 13, wherein the transparent optical part comprises collimating elements or other optical elements to route light rays to a required direction.

* * * * *